US010738793B2

(12) United States Patent
Farmer et al.

(10) Patent No.: US 10,738,793 B2
(45) Date of Patent: Aug. 11, 2020

(54) COMPACT CENTRIFUGAL APPARATUS FOR CONVEYING A FLUID

(71) Applicants: Hannah Farmer, Lake Elmo, MN (US); Kenneth Farmer, Lake Elmo, MN (US)

(72) Inventors: Hannah Farmer, Lake Elmo, MN (US); Kenneth Farmer, Lake Elmo, MN (US)

( * ) Notice: Subject to any disclaimer, the term of this patent is extended or adjusted under 35 U.S.C. 154(b) by 0 days.

(21) Appl. No.: 15/977,669

(22) Filed: May 11, 2018

(65) Prior Publication Data

US 2019/0078579 A1 Mar. 14, 2019

Related U.S. Application Data

(60) Provisional application No. 62/505,599, filed on May 12, 2017.

(51) Int. Cl.

| | |
|---|---|
| ***F04D 29/28*** | (2006.01) |
| ***F04D 17/08*** | (2006.01) |
| ***F04D 29/22*** | (2006.01) |

(52) U.S. Cl.

CPC ..... *F04D 29/28* (2013.01); *F04D 17/08* (2013.01); *F04D 29/225* (2013.01); *F04D 29/2255* (2013.01); *F04D 29/281* (2013.01)

(58) Field of Classification Search

CPC .... F04D 29/28; F04D 29/225; F04D 29/2255; F04D 29/281; F04D 17/08; F04B 19/20

See application file for complete search history.

(56) References Cited

U.S. PATENT DOCUMENTS 1,518,455 A * 12/1924 Roth ..... F04D 29/28 416/186 R 4,419,043 A * 12/1983 Smith ..... F04D 29/225 415/7

2013/0336806 A1 12/2013 Reid et al.

* cited by examiner

*Primary Examiner* — Richard A Edgar

*Assistant Examiner* — Maxime M Adjagbe

(74) *Attorney, Agent, or Firm* — Jose' W. Jimenez; Jimenez Law Firm

(57) ABSTRACT

An improved centrifugal pump uses straight tubes or fluid channel members rather than expanding passages between the inlet and exit flow. In straight tubes a process occurs of building up of pressure faster than within the passages as the fluid attempts to expand due to the Coriolis force potentially acting against the centrifugal force to build up the pressure within and along the tube or fluid channel. Because the flow increases faster than increases in RPM a more compact pump is provided that can move more air and produce higher pressures than ordinary centrifugal pumps. Hence: 1) Flow increases proportional to tube area because a larger area means more air can be drawn into the tube; 2) Flow increases proportional to tube length because the exit pressure increases proportional to tube length; and 3) Flow increases faster than increases in RPM, thereby exhibiting a higher outflow pressure.

5 Claims, 16 Drawing Sheets

*Design with maximum tube density.*

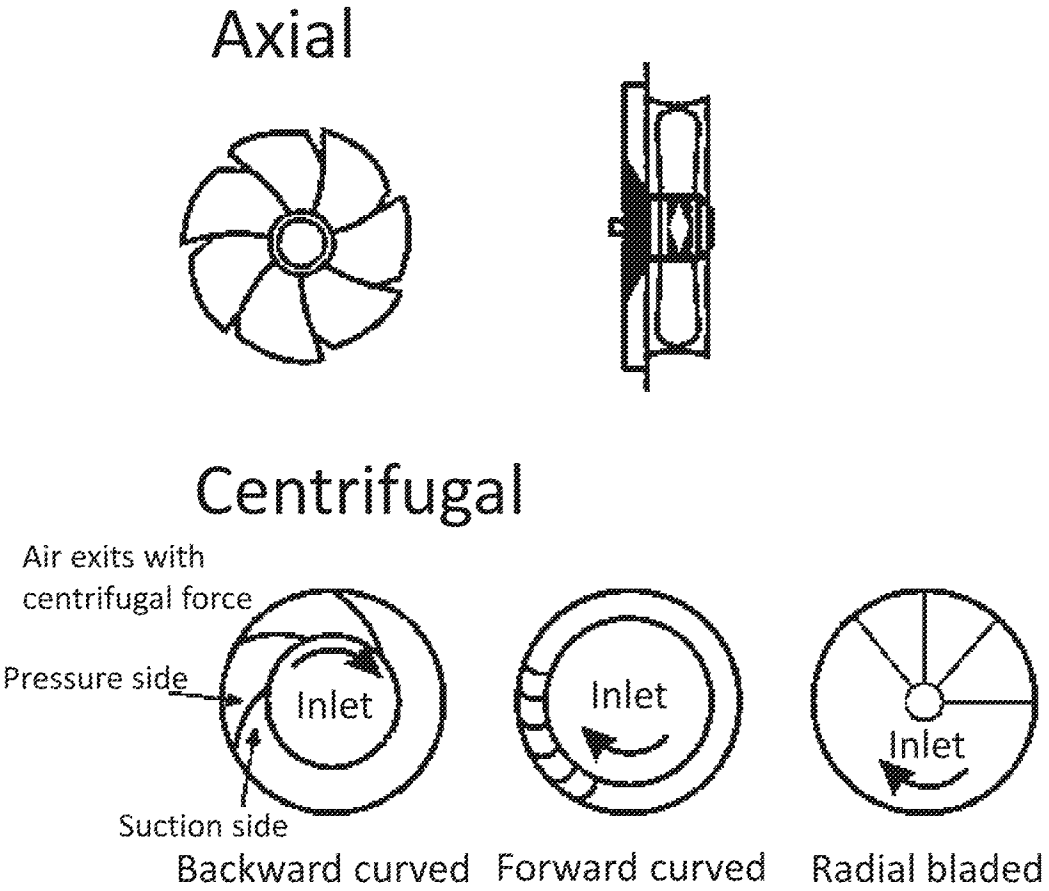
*FIG. 1 Prior Art- difference between axial and centrifugal fans*

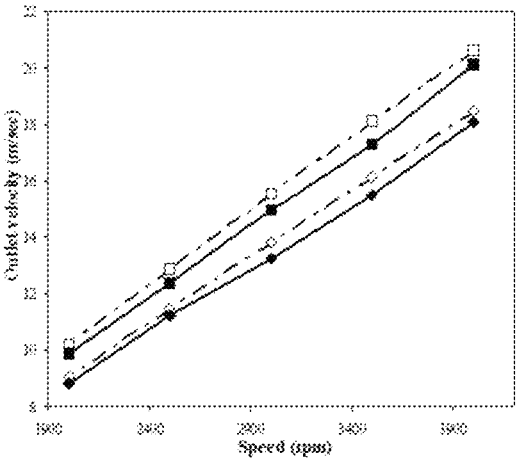
FIG. 2 Centrifugal fan flow (or velocity) usually increases linearly with rotational speed.

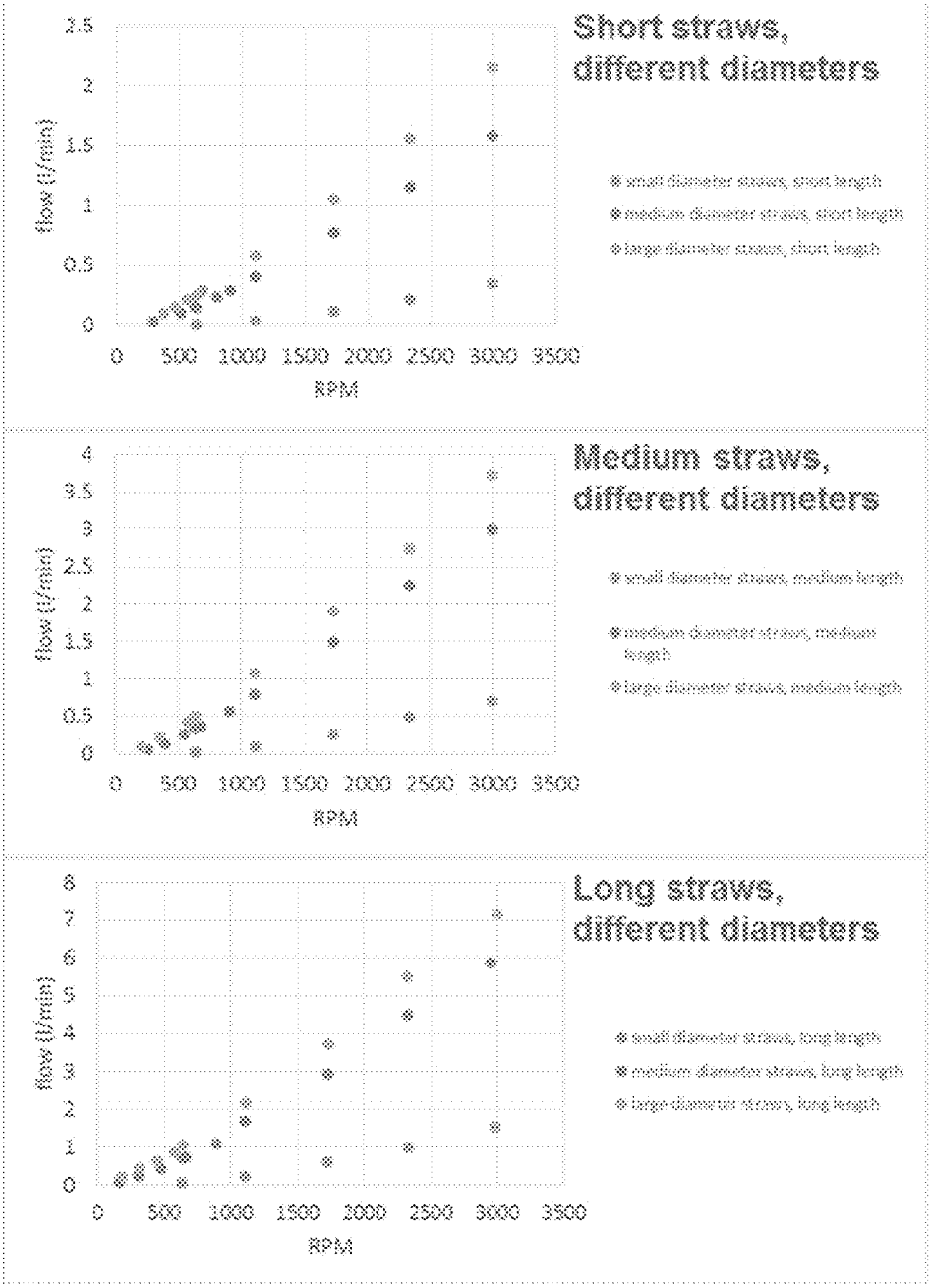
FIG. 7 Flow versus RPM for straws with different diameters.

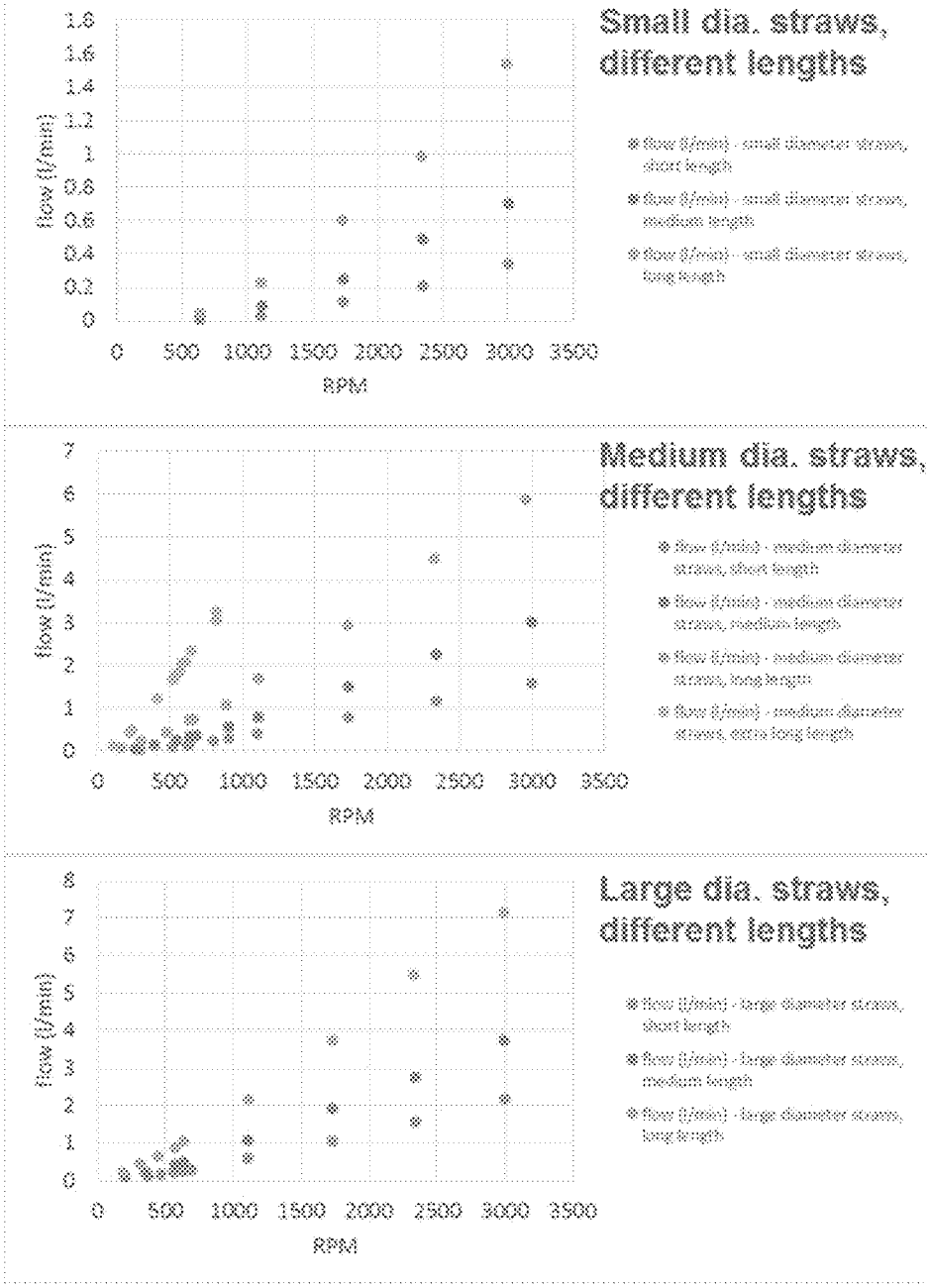
FIG. 8 Flow versus RPM for straws with different lengths.

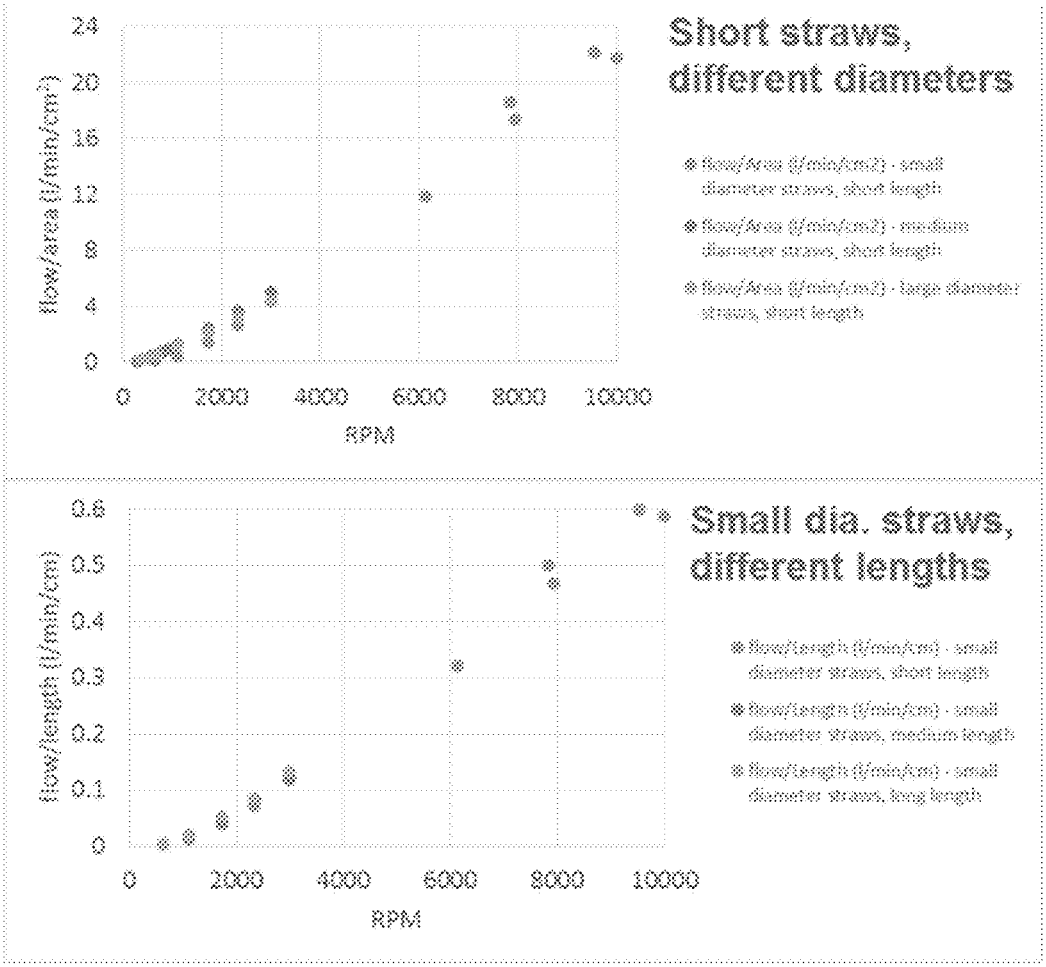
FIG. 9 Flow is proportional to the straw area and length.

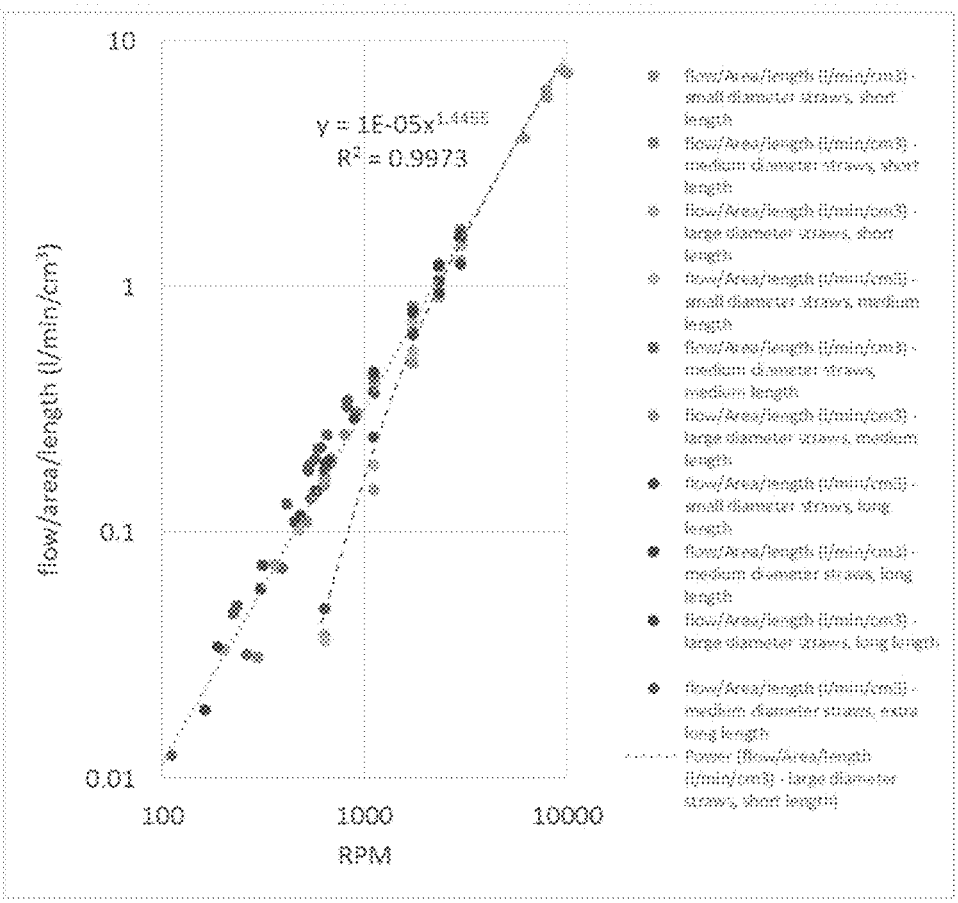
FIG. 10 Log-Log plot of flow divided by area and length versus RPM.
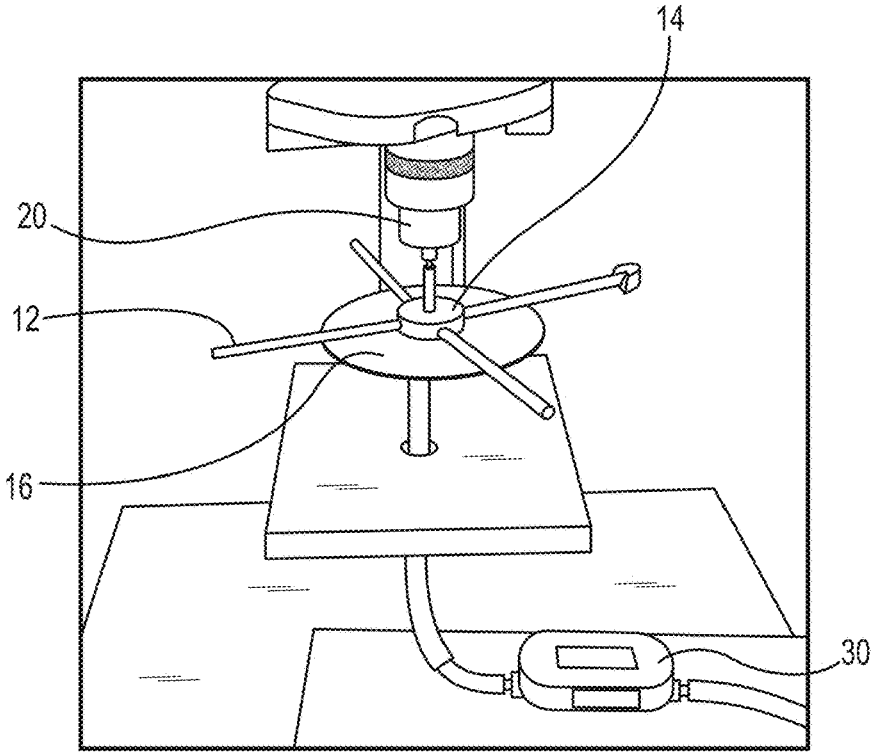
FIG. 11

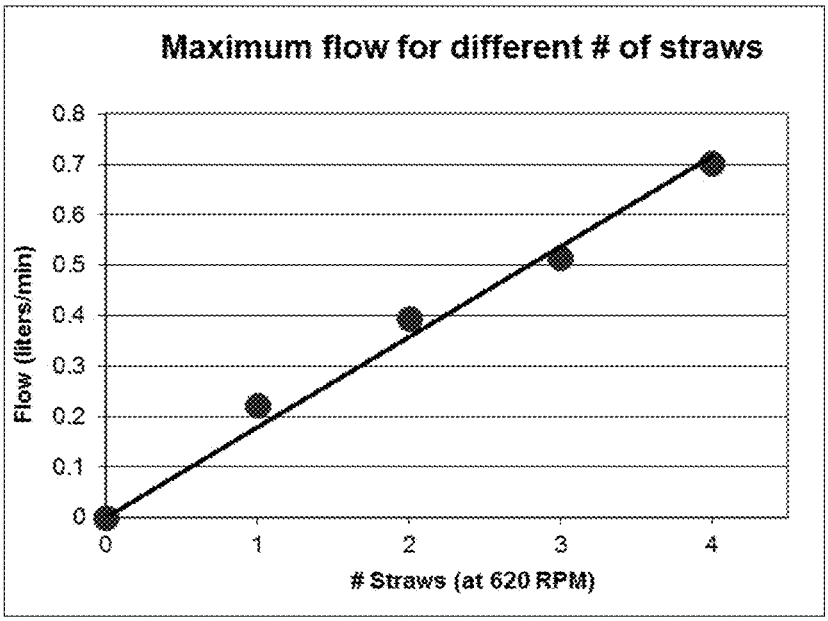
FIG. 12 Flow increases proportional to area as more tape is removed from the tubes.
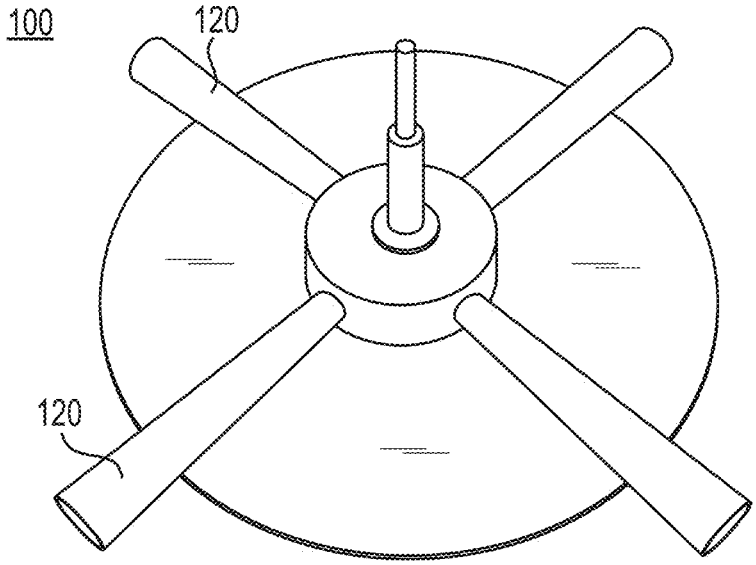
FIG. 14

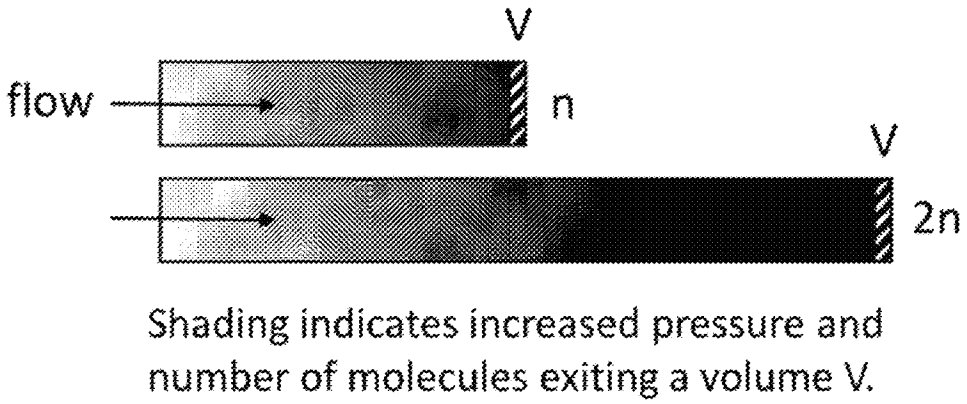
*FIG. 13 If pressure increases proportional to tube length, flow does too.*

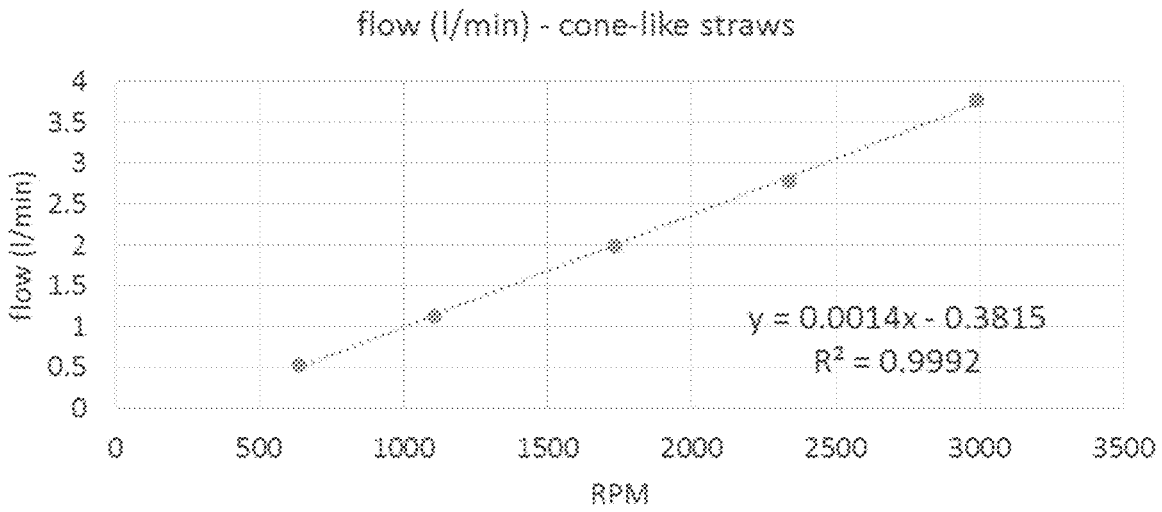
FIG. 15 Flow is proportional to RPM in cone-like straws or tubes.
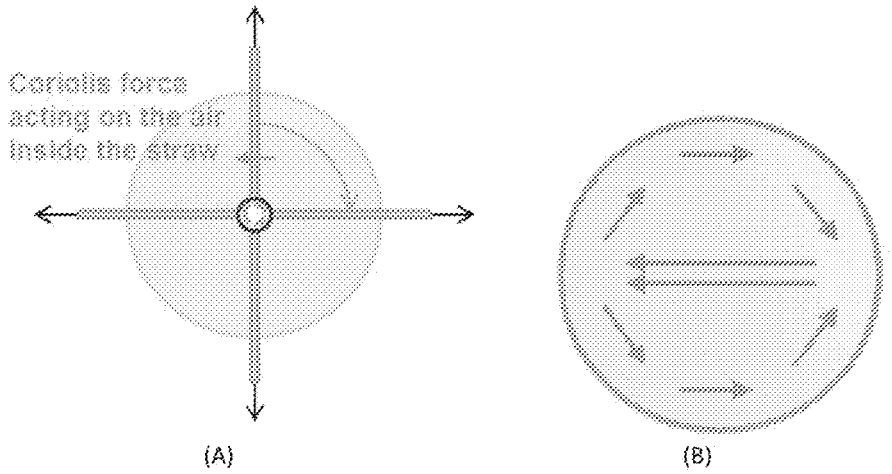
*FIGS. 16A and 16B - (A) Coriolis force acting inside the straw. (B) Secondary flow caused by Coriolis force.*

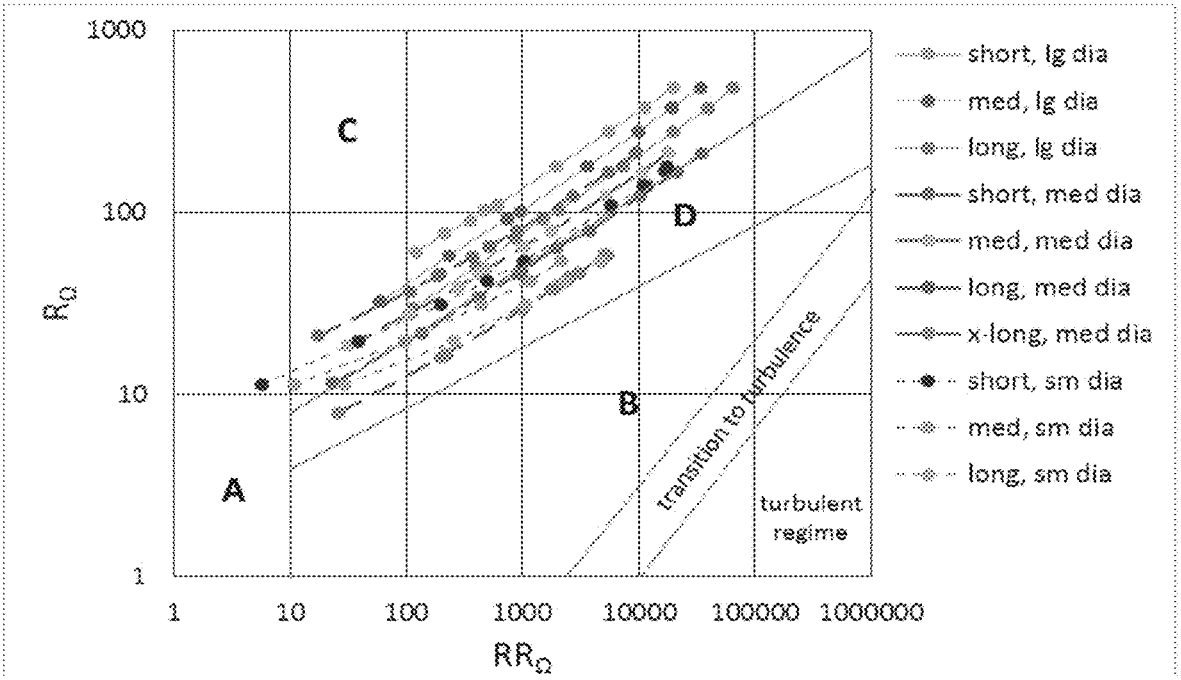
FIG. 17
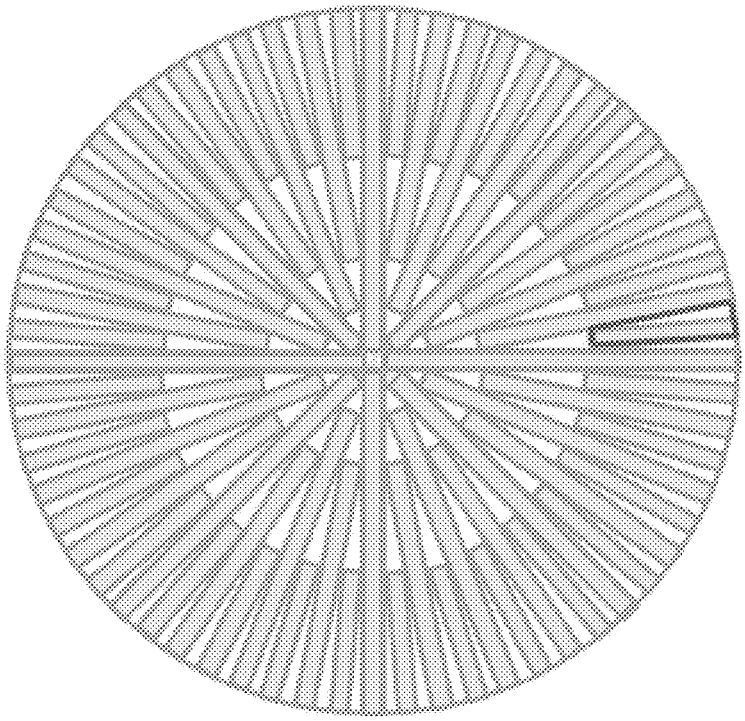
*FIG. 18 Design with maximum tube density.*

SMALL DIAMETER INLET ERROR

| | |
|---|---|
| AREA OF INLET (BLUE RING) | 1.77 $cm^2$ |
| AREA OF GAP | 0.44 - 1.13 $cm^2$ |
| % ERROR | 25 - 64% |

LARGE DIAMETER INLET ERROR

| | |
|---|---|
| AREA OF INLET (BLUE RING) | 73.9 $cm^2$ |
| AREA OF GAP | 8.86 - 14.5 $cm^2$ |
| % ERROR | 12 - 20% |

COMPACT CENTRIFUGAL APPARATUS FOR CONVEYING A FLUID

CLAIM OF PRIORITY

This application claims the benefit of and priority to U.S. Provisional Application with Ser. No. 62/505,599, filed on May 12, 2017, with the same title, the contents of which are hereby incorporated by reference in its entirety.

FIELD OF THE INVENTION AND BACKGROUND

The invention is generally in the field of centrifugal pumps and fluid flow devices.

In the field of pumps and fans, there are generally two types: axial and centrifugal. As illustrated in FIG. 1, in axial devices flow is along the axis, while in centrifugal devices flow enters through a central inlet and exits perpendicular to the inlet flow due to centrifugal force. The volume between centrifugal fan blades usually expands out from the inlet to the exit. As shown in FIG. 2, a classic property of centrifugal fans is that the fan flow usually increases proportional to rotational speed. With both designs, in order to move more air and increase pressures, the size of the fan blades and motor have to increase which in some applications would be undesirable where space is at a premium.

In one prior art rotating radial tube pump device, Reid et al., (U.S. Patent Publication 20130336806) disclose a rotating pump in which a solid disk or rotary portion having more than one cylindrical traverse passageway having outlets at the edge of the rotary portion and having inlets connected to a center cylindrical inlet passageway that is perpendicular to and bisects the traverse passageways in the solid rotary portion. One of the main teachings of Reid is increase in the flow area by increasing the size of the air passageways without increasing the diameter of the disk or tubular passageways disclosed. However, even though the amount of fluid appears to increase with increasing passageway diameters the outlet force appears to stay the same. In one preferred embodiment, a cone-shaped passageway is taught to increase amount of fluid outflow without changing the overall disk shape or size but the outlet force still appears to stay the same.

Therefore, there is a need in the art for a compact pump or centrifugal device that moves more air and produces higher pressures in a smaller form factor than current devices.

SUMMARY OF THE INVENTION

There is provided a radically new type of centrifugal flow device having a preferred use, but not necessarily limited to, in a hovercraft, in which the flow increases faster than increases in RPM (unlike in traditional centrifugal devices) and moves more air and produces higher pressures than ordinary centrifugal pumps. It has been discovered that a centrifugal flow pump device has flow that increases superlinearly with increased revolutions per minute (RPM) of the device using, but not necessarily limited to, a set of substantially cylindrical tubes disposed about a round plate or disk. In one example embodiment, the tubes are disposed at the 90, 180, 270 and 360 degree positions (or 12, 3, 6 and 9 o'clock positions on a clock) with the inlets of the tubes disposed at an inlet manifold at the interior of the disk and the outlet of the tubes disposed at the outer edge of the disk. This effect can be used to make a more compact pump, for a hovercraft for example, that moves more air and produces higher pressures than ordinary pumps.

Variations of centrifugal device design involving measuring the resulting flow at different RPMs illustrate the effects of: tube diameter on flow, the effect of tube length on flow and the effect of rotational speed on flow. Each experiment has its own hypothesis: 1) Flow will increase as the tube area increases because a larger area means more air can be drawn through the tubes. 2) Flow will increase as the tube length increases because longer tubes can hold more air. 3) Flow will increase as the RPM increases because the centrifugal force will be stronger at higher RPM. This work is important because the results will provide guidance on how to build a pump that is more compact and produces higher pressures than ordinary pumps.

In one example embodiment, there is provided an improved centrifugal airflow pump assembly that includes an inflow rotating impeller device including a substantially circular base member supporting a plurality of individual fluid channel members disposed along radii on a top surface of the base member, wherein an inlet of the fluid channel members is configured to be exposed to a fluid flowing through the channel members. The airflow pump assembly also includes a rotating mechanism coupled to the base member of the impeller device at a center point of a bottom surface of the base member to facilitate axial movement of the base member, the rotating mechanism rotating the base member and fluid channel members at a defined rate of revolutions per minute (RPM), wherein an increase of a flow rate of fluid exiting an outlet of the fluid channel members is faster than an increase in RPM (superlinear), and wherein the increased exiting fluid flow is a function of the structure of each of the plurality of the fluid channel structures and exposure of the inlets to the fluid flowing through the channel members. In a related embodiment, all of the fluid channel members do not all have to be axially equidistant from each other and the fluid is not limited to air. Some of the fluid channel structures can have one separation distance and some can have another distance. In a preferred embodiment, the channel structures appear to exhibit improved performance when along a radius of a circular support disc.

In yet another example embodiment, a method is provided for forming a superlinear outflow of fluid at an outlet of a fluid channel member of a fluid flow pump assembly including the steps of providing a plurality of individual fluid channel members disposed along radii of a top surface of a planar circular base member, wherein an inlet of the fluid channel members is exposed to the a fluid flowing through the channel members. The method also includes the step of rotating axially the planar circular base member at a center point of a bottom surface of the base member, wherein the base member and fluid channel members are rotated at a defined rate of revolutions per minute (RPM), and wherein an increase of a flow rate of fluid exiting the fluid channel members is faster than an increase in RPM (superlinear).

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DESCRIPTION OF THE DRAWINGS

FIG. 1 illustrates a prior art difference between axial and centrifugal fans.

FIG. 2 illustrates a centrifugal fan flow (or velocity) which usually increases linearly with rotational speed.

FIG. 7 illustrates various graphs of flow versus RPM for straws (circular cylindrical tubes) with different diameters.

FIG. 8 illustrates various graphs of flow versus RPM for straws (circular cylindrical tubes) with different lengths.

FIG. 9 illustrates various graphs of flow that is proportional to the straw (circular cylindrical tube) area and length.

FIG. 10 illustrates a Log-Log plot of flow divided by area and length versus RPM.

FIG. 11 illustrates an example of where tape is used to seal off tube ends to see if flow increases proportional to area.

FIG. 12 illustrates that flow increases proportional to area as more tape is removed from the tubes.

FIG. 13 illustrates how, if pressure increases proportional to length, flow does as well.

FIG. 14 illustrates a test device with cones instead of straight tubes.

FIG. 15 illustrates a flow that is proportional to RPM in cone-like straws or tubes.

FIGS. 16A and 16B illustrate a Coriolis force acting inside the straw or tube and a secondary flow caused by Coriolis force, respectively.

FIG. 17 illustrates different flow regimes and plots the measured data in terms of Reynolds numbers.

FIG. 18 illustrates a centrifugal device design with maximum tube density.

DETAILED DESCRIPTION OF THE PREFERRED EMBODIMENTS

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Figure 3A:
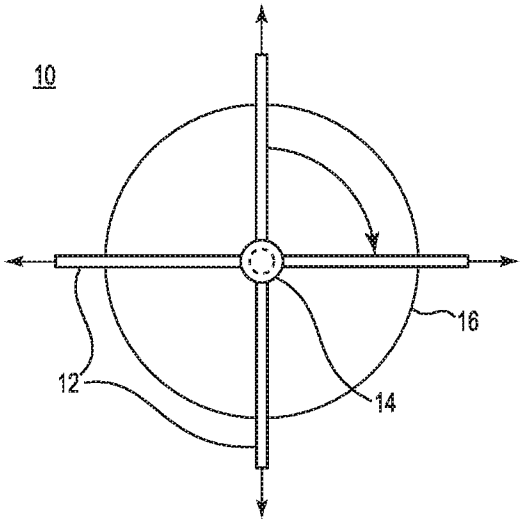
FIGS. 3A and 3B illustrate bottom and side views of a centrifugal device that uses straight tubes instead of expanding volumes.
Figure 3B:
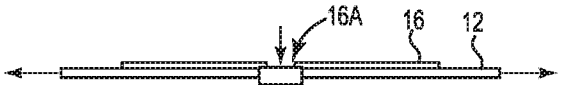

Referring now to the figures, in FIGS. 3A and 3B there is illustrated an improved centrifugal pump device 10 with the main difference between the improved device and a typical centrifugal fan being that the air path does not expand radially outward in the present design.

Looking at the bottom view in FIG. 3A, as the device spins about its center (center ¼ arrow; yellow arrow), air in a set of tubes 12 (4 tubular arms at 0, 90, 180 and 270 degree positions) is accelerated to the outside 12B (black arrows) by centrifugal force. The tubes are inserted and taped in holes in the side of a manifold 14 (center, red circle) which is glued with its open side 12A to a plastic disc or base 16 (larger center circle; grey circle). For testing purposes, the unit is mounted to a drill using a mandrel attached to the center of the manifold (not shown). Looking at the side view through the center in FIG. 3B, as air is forced to the outside (horizontal arrows), air is drawn in through an opening 16A in the top of the plastic disc 16 (vertical arrow).

Example One

Measurements were taken of the flow through the hole in the plastic disc at different spinning speeds for different tube diameters and different tube lengths using combinations from the following table (over 200 measurements in total). Prior to each flow measurement, the rotational speed was determined and recorded using a tachometer.

| Tube diameters | Tube lengths | Rotational speeds |
|---|---|---|
| 0.317 cm | 2.94 cm | <620 RPM using electric drill |
| 0.635 cm | 5.87 cm | 620 to 3000 RPM using drill press |
| 0.794 cm | 11.7 cm<br>29.5 cm | >3000 RPM using Dremel |

Each measurement was repeated 3 times. To test the underlying cause of the rapid (superlinear) increase in flow with rotational speed, a test system was built using cones instead of straight tubes, then the flow through these cones was measured as a function of RPM.

Considering the following variables:

Dependent Variable:

Air flow (liters/min).

Independent Variables:

Tube length (4 different lengths), tube diameter (or area, 3 different values), rotational speed (ranging from 100 to 10,000 RPM), tube shape (straight tube or cone-like), number of tubes (usually 4, but varied from 1 to 4 in one experiment).

Controlled Variables:

Each of the independent variables while only one is varied, temperature (room temperature), tube material (light weight plastic drinking straws), distance of tube inlet from center of rotation (0.5 cm), size of inlet (hole in plastic disc (a CD)), length and diameter of tube running between the test unit and the flowmeter.

Materials List and Data Collection

Centrifugal flow test units

Figure 4:
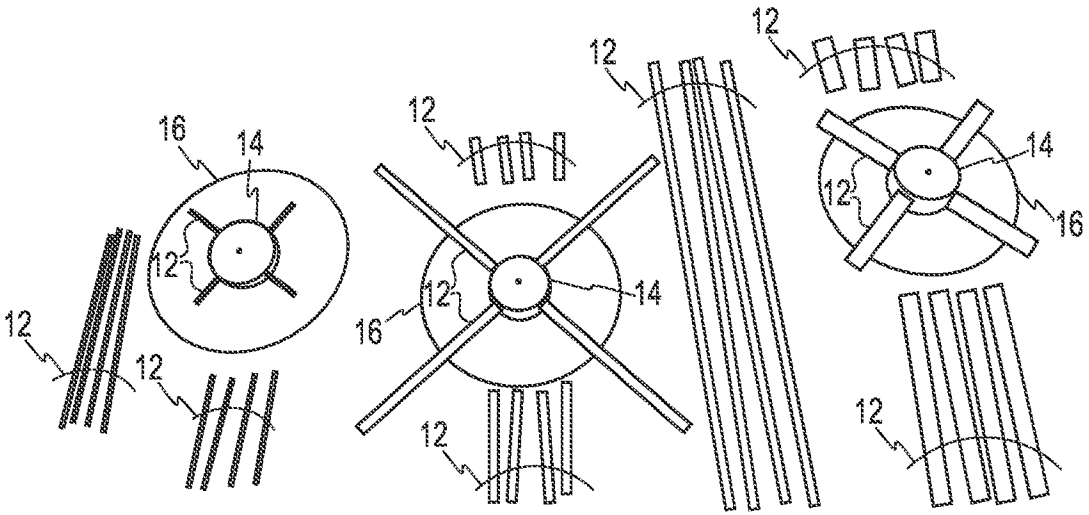
FIG. 4 illustrates CD discs, tubes and caps or lids used to build test units.

- Made using drinking straws or tubes inserted in holes drilled in a milk jug lid attached to a CD disc (or plastic disc) using Gorilla Glue and tape 4 different tube lengths and 3 different tube diameters
Drill press, Dremel and electric drill that can run at different speeds
A mandrel 18 to connect the flow units to the drills
Safety glasses
A ruler to measure tube lengths and diameters and scissors to cut the tubes
Tachometer to measure rotational speeds
Flow sensor with rubber tube about the same outer diameter as the hole in the CD disc to measure the flow of air through the test units
PC and Excel software for plotting, reviewing and analyzing data FIG. 4 illustrates the components used to build the various test units.

Figure 5:
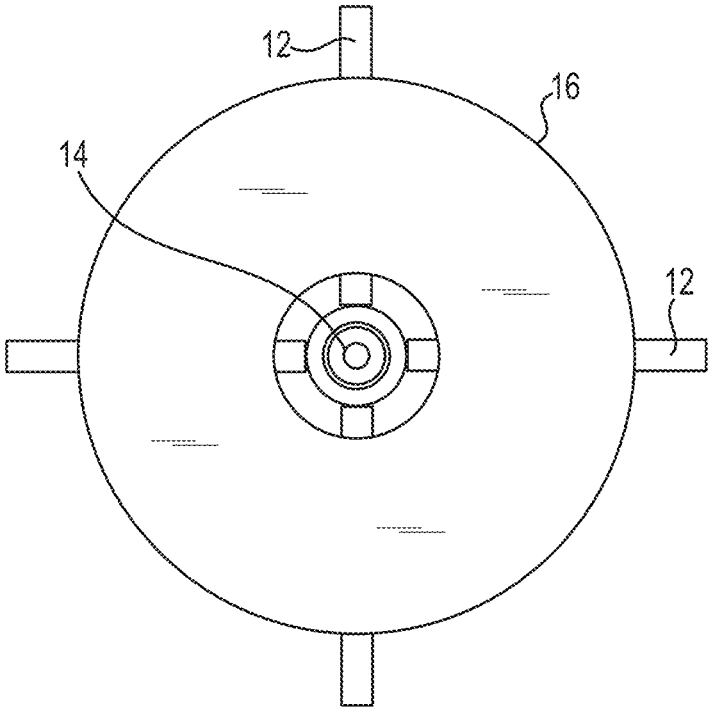
FIG. 5 illustrates a bottom of a CD disc showing an inlet hole through which air flows.
Figure 6:
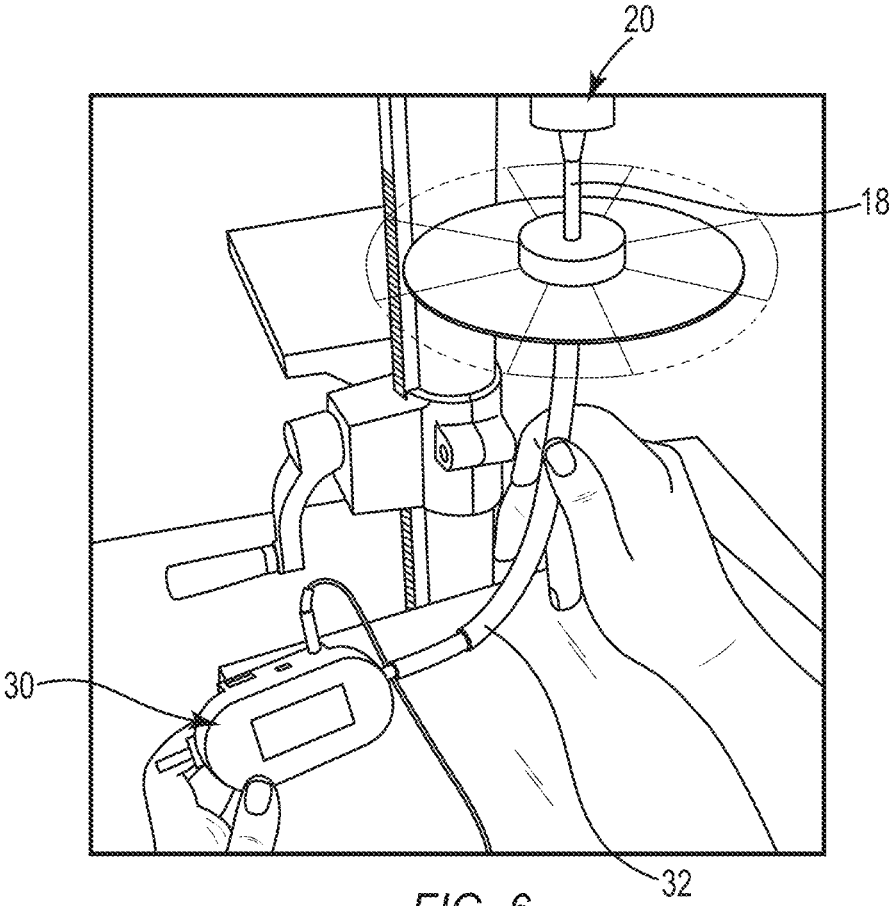
FIG. 6 illustrates a spinning test unit wherein the flow meter reads 0.310 liters/min.

FIG. 5 illustrates the hole 16A in the plastic disc 16 through which air is drawn or pulled into when the plastic disc rotates. FIG. 6 illustrates a test unit spinning on a drill press 20 and the flow meter 30 used to measure the flow through the hole 16A in the plastic disc 16.

Results

All of the data for all of the experiments are shown in the supporting data tables at the end of the Detailed Description of the Preferred Embodiments section. The results for flow through tubes with different diameters are shown in FIG. 7. In the figure, for short (top graph), medium (middle graph) and long (bottom graph) tubes, the air flow at each RPM increases with increasing diameter. In all cases, the flow increases more rapidly than the RPM. This is a key finding because this effect can be used to make a more compact pump that moves more air and produces higher pressures than ordinary pumps where flow increases only proportional to RPM. The graphs look similar for the different tube lengths, only with different flow scales (showing that flow increases with length as well as diameter).

The results for flow through straws or tubes with different lengths are shown in FIG. 8. In the figure, for small (top graph), medium (middle) and large (bottom) diameter tubes, the air flow at each RPM increases with increasing tube length. In all cases, the flow increases more rapidly than the RPM. The graphs look similar for the different tube diameters, only with different flow scales (showing that flow increases with diameter (area) as well as length).

FIG. 9 illustrates that flow is proportional to the area and length of the tubes. The top graph plots flow divided by the area for the short tubes for three different diameters. The data roughly fall on a single curve which illustrates that the flow is approximately proportional to area for the short tubes. Similar results are seen for the other tube lengths. The bottom graph plots flow divided by the length for the small diameter tubes for three different lengths. Again the data roughly fall on a single curve which illustrates that the flow is approximately proportional to tube length for the small diameter tubes. Again, similar results are seen for the other tubes. In both cases, the flow increases faster than the RPM.

FIG. 10 illustrates that flow increases faster than the RPM, hence in a superlinear fashion. Since flow is proportional to area and length, in this plot of flow divided by area and length versus RPM, the data fall on roughly a single curve. The (light grey) dotted line on the log-log graph illustrates that most of the data can be described by an equation where the flow divided by the area and tube length is proportional to $(RPM)^{1.4455}$. The (blue) dashed line indicates that at lower RPM, the flow in the small diameter tubes is harder to get started, but at higher RPM it behaves like flow in the other tubes.

Analysis: Different Areas

The result shown in FIG. 7, where flow that increases proportional to area, is expected. This can be proven by taping off the ends of the tubes and plotting flow for different numbers of open tubes. The photo in FIG. 11 illustrates a test unit attached to the drill press 20 and a flow meter 30 with hose 32 measuring flow of air through the inlet. Tape seals off the end of one of the four tubes. The graph in FIG. 12 illustrates that air flow increases proportional to area as tape is removed from each tube.

Analysis: Different Lengths

The increase in flow proportional to the length of a tube (FIG. 8) can be explained if the pressure along a tube increases proportional to the length of a tube. If this happens, then using the ideal gas law (PV=NRT), the number of molecules N exiting a small volume V at the end of the tube in some time t (in other words, the flow) is proportional to the length of the tube or straw because V, R and T are constant. This is illustrated in FIG. 13.

Analysis: Flow Increasing Faster than RPM

The analysis of flow increasing faster than RPM is seen in FIG. 10, which illustrates that flow increases faster than the RPM in straight tubes as air flows into the inlet of the tubes and then is expelled at the outlet very quickly. It appears that the superlinear flow increases with increasing RPM in the present device is due to the fact that the tubes are straight, rather than expanding radially similar to typical centrifugal fan designs. To test this a device 100 was constructed so as to measure flow at different RPMs in a device 100 with cone-like tubes 120, similar to device 10, that gradually increase tube size from 0.635 to 0.794 cm diameter. The special test device 100 with cones is shown in FIG. 14.

The results from this test are shown in FIG. 15. Flow in cones increases proportional to RPM, not $(RPM)^{1.4455}$. This suggests that in the straight tubes there is a process that builds up the pressure faster than in expanding passages. Pressure appears to build up from the inlet to the outlet of the fluid channels involves one or more Coriolis forces. As represented by the green arrow in FIG. 16*a*, a Coriolis force acts perpendicular to the flow and perpendicular to the plane of rotation. This sets up two oppositely rotating "secondary" flow paths as shown in FIG. 16*b*. In FIG. 16*b* the main flow is into the page and the tube rotation is to the right (clockwise). The Coriolis force on the center part of the secondary flow (out of the page) works against the centrifugal force (into the page), building up pressure. The open and exposed inlet of the fluid channels facilitate rapid air movement into the fluid channels and the Coriolis forces work to increase the pressure as the fluid travels through the fluid channel and out of the outlet. It should be noted that the actual flow in rotating straight tubes is even more complex.

Lei and Hsu (U. Lei and C. H. Hsu, "Flow through rotating straight pipes," Physics of Fluids A, Vol. 2, pp. 63-75, (1990)) among others have studied flow in rotating straight tubes numerically. They plot their results in terms of the Reynolds Number, R and the Rotational Reynolds Number, $R_{\Omega}$, where $$R = \text{mean velocity} \times \frac{\text{tube radius}}{\text{fluid viscosity}} = \frac{Q}{A} \times \frac{a}{\nu}, \text{ and}$$

$$R_\Omega = \text{angular speed} \times \frac{(\text{tube radius})^2}{\text{fluid viscosity}} = \frac{2\pi}{60} \times RPM \times \frac{a^2}{\nu}.$$

They find that the flow falls into four regimes: A) When both $R_\Omega$ and R are low, flow is similar to that in a non-rotating tube; B) When $R_\Omega$ is low and R is high, maximum flow is skewed towards the trailing edge of the tube; C) When $R_\Omega$ is high and R is low, the center flow is reduced and high speed vortexes are formed at the top and bottom of the tube; and D) When both $R_\Omega$ and R are high, the flow is in transition between two vortexes and flow that is skewed towards the trailing edge. This is illustrated in FIG. 17 which defines the boundaries of regimes A through D and replots the data of FIG. 10 in terms of the Reynolds numbers. This figure shows that for the various configurations tested, the geometry determines the flow regime, which, for a particular configuration does not change as the RPM increases. The figure also shows that for the various configurations tested, the flow contains two vortexes that are located closer to the trailing edge as the tubes get either longer in length or smaller in diameter.

Maximizing Tube Density

In another embodiment, illustrated in FIG. 18 airflow is maximized by maximizing tube density (e.g., increasing the number of fluid channel members located on the surface of the disk) on the round disk. The figure illustrates that ⅔ of the area of a plate can be covered with tubes arranged along a radius. Each round tube fills $\pi/4$ times the volume of a tube of square cross-sectional area of the same length. Thus a disc of this new design can fill only $\pi/6$ or ~52% times the volume of a traditional centrifugal pump design. Nonetheless, at higher RPM the new design can overcome the initial disadvantage at low RPM because of the superlinear increase in flow with RPM generated within the fluid channel members.

Figure 19:
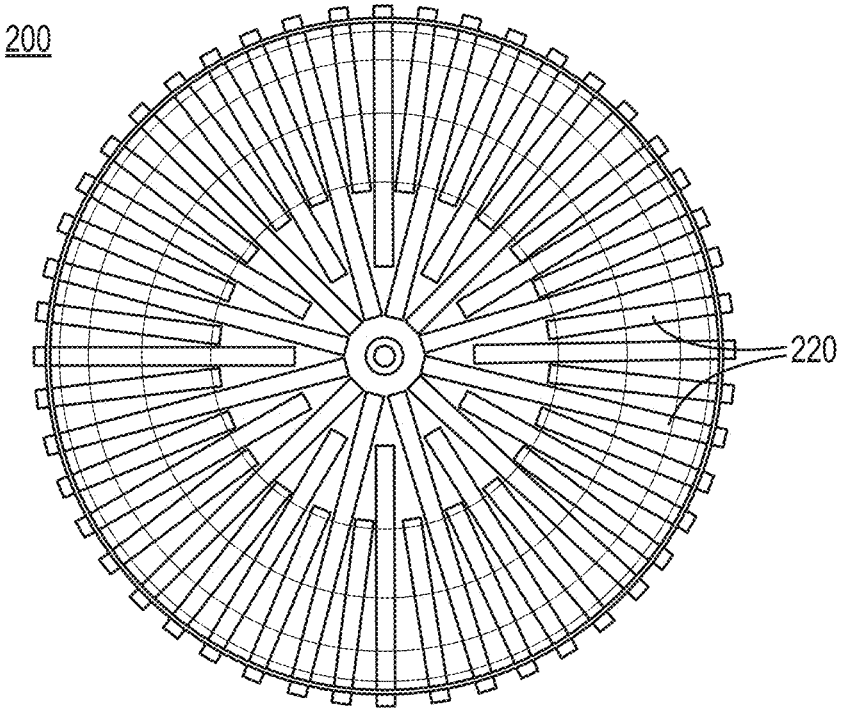
FIG. 19 illustrates a centrifugal device design with maximum tube density.

In the following example, a 48 tube design 200 was used with 0.63 cm diameter tubes 220 and lengths ranging from 10.2 to 5.6 cm (see FIG. 19). In a related embodiment, the disc has a 100 mm diameter inlet hole where the initial prototype had 10 mm diameter inlet hole which limited the flow. The related example embodiment uses a new adapter between the flow-meter and the inlet due to the increased flow.

Increasing Tube Inlet Distance from Center of Rotation

Figure 20:
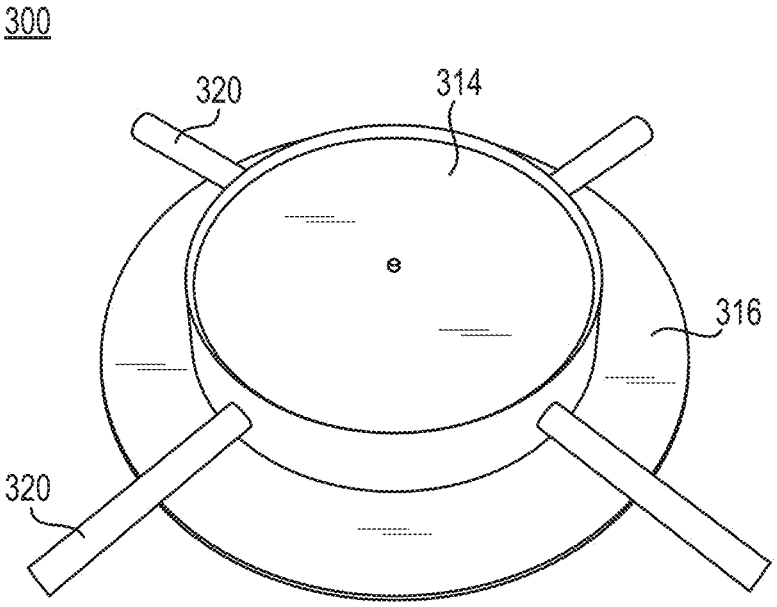
FIG. 20 illustrates an example embodiment a centrifugal device where the tubes are located at different distances from the center of rotation.

In order to model the flow through the prototype with maximum tube density, a test device 300 was constructed as illustrated in FIG. 20. Flow was measured at different RPM in the device with tubes 320 placed on a disc 316, and in a manifold 314, with their inlets at increasing distances from the center of rotation: 1.0, 2.1 and 3.2 cm. Medium length, medium diameter tubes were used.

Figure 21:
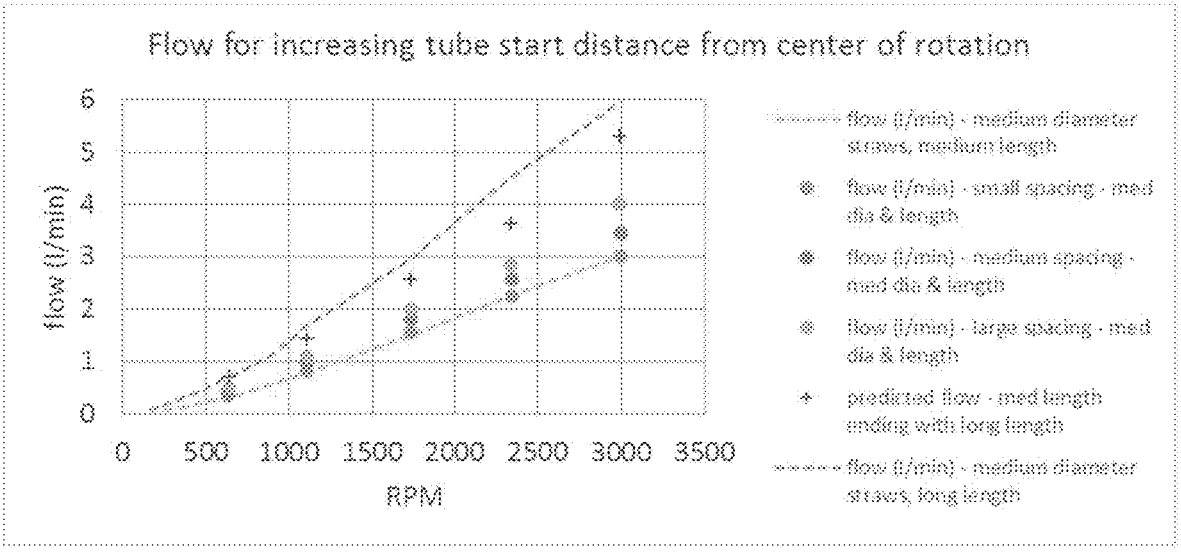
FIG. 21 illustrates the increase in flow from the center of the base member or circular disk as the tube inlet moves outward towards the edge of the disc.

As illustrated in FIG. 21 it was found that flow increases with increasing inlet distance from the center of rotation. ~90% flow is predicted through a tube that has the same end point as a tube that is twice as long. Using these results, one can predict the flow for each tube segment in a scaled up design containing 48 tubes as shown in the table below:

| # Straws | Length (cm) | Distance from center (cm) | Predicted contribution to measured flow |
|---|---|---|---|
| 3 | 10.2 | 0.5 | 3 × 1.0 Qmax = 3 Qmax |
| 3 | 9.9 | 0.8 | 3 × (0.99)$Q_{max}$ = 2.97 Qmax |
| 6 | 9.5 | 1.2 | 6 × (0.98)$Q_{max}$ = 5.88 Qmax |
| 12 | 8.1 | 2.6 | 12 × (0.96)$Q_{max}$ = 11.52 Qmax |
| 24 | 5.6 | 5.1 | 24 × (0.90)$Q_{max}$ = 21.60 Qmax |
| | | Total: | 45.0 $Q_{max}$ |

One can also predict the flow for the 48 tube prototype at different RPM and compare the predictions to measured results. This is done in the table below:

| Max Straw Length (cm) | RPM | Qmax (L/min) ($Q_{long,\ med\ dia}$ × 10.2/11.7) | Predicted flow (L/min) (45.0 × $Q_{max}$) | Measured max flow (L/min) |
|---|---|---|---|---|
| 10.2 | 636 | 0.16 | 7.0 | 12.9 |
| 10.2 | 1106 | 0.37 | 16.5 | 26.8 |
| 10.2 | 1727 | 0.64 | 28.9 | 44.3 |
| 10.2 | 2326 | 0.98 | 44.1 | 63.6 |
| 10.2 | 2955 | 1.28 | 57.6 | 84.2 |

Figure 22:
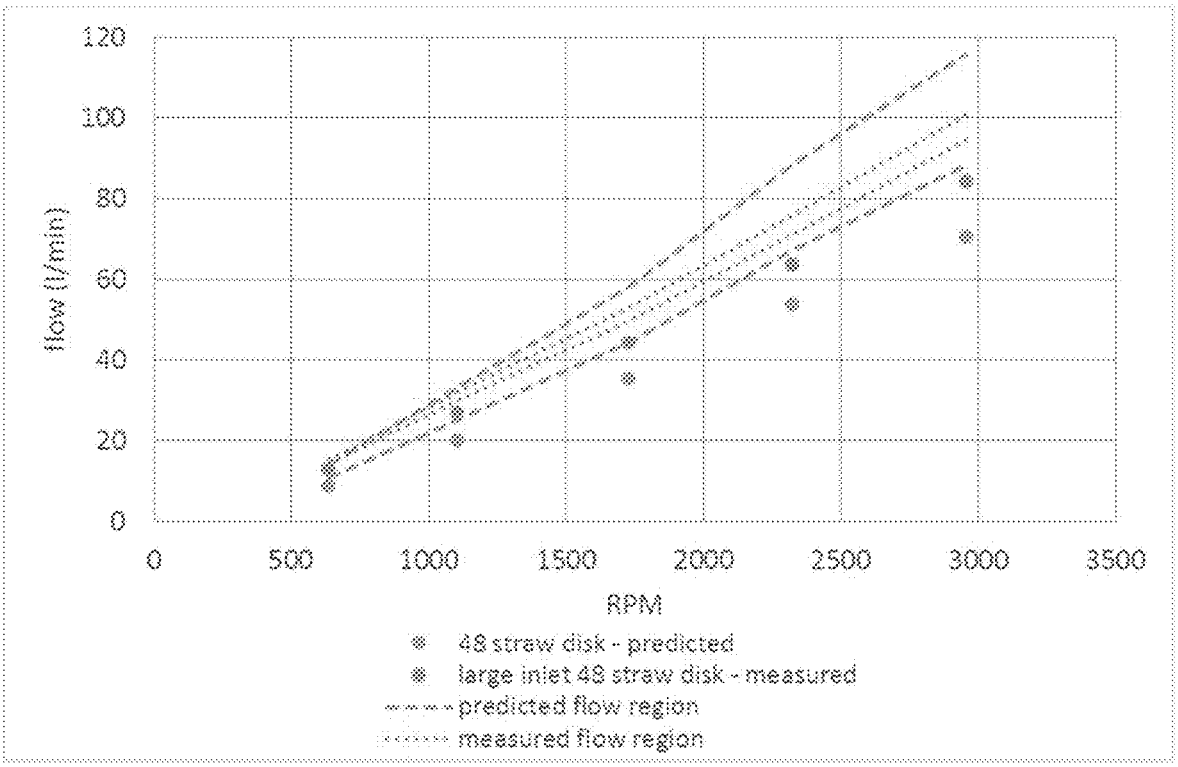
FIG. 22 illustrates for a 48 tube configuration, predicted and actual flow regions captured in graphical form.
Figure 23A:
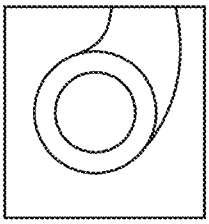
FIGS. 23A and 23B illustrate a tube and a cup, with associated dimensions, and the inlet hole that are coupled to the centrifugal device.
Figure 23B:
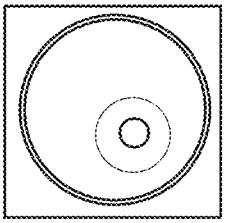

FIG. 22 shows that error analysis for the measured flow in the scaled up design yields a measured flow region (dotted lines) that falls within the bounds of a predicted flow region (dashed lines). Sources of error are described and illustrated below:

Air gets drawn into the device through the connection to the flow meter, but it also leaks around the gap between the connection (illustrated in FIG. 23A as being a tube with associated dimensions or as illustrated in FIG. 23B as being a cup with associated dimensions) and the inlet hole.

The measured flow, even though it is the maximum flow meter reading, underestimates the actual flow by a fraction that is the ratio of the gap to the total inlet area.

The predicted flow, based on the small diameter inlet, underestimates by 25 to 64%.

The measured flow, based on the large diameter inlet, underestimates by 12 to 20%.

Hence, in view of the foregoing it is concluded that:

1. Flow increases proportional to tube area because a larger area means more air can be drawn into the tube.
2. Flow that increases proportional to tube length can be explained if the exit pressure increases proportional to tube length.
3. Flow increases faster than RPM. This appears to be because in the straight tubes there is a process that builds up the pressure faster than in expanding passages. It is concluded that the Coriolis force(s) acts against the centrifugal force to build up the pressure throughout the tube or fluid channel member.

It appears that the flow in each tube contains two vortexes that are located closer to the trailing edge as the tube gets either longer in length or smaller in diameter. Also the geometry of the tube determines the flow type, which doesn't change as the RPM increases. Finally, a scaled-up prototype that maximizes tube density has been designed, constructed and tested and appears to pump the amount of air predicted from measurement results for smaller test devices.

Other example embodiments that include applications beyond hovercrafts are suggested as follows from the discoveries discussed herein:

1) Calculate the flow and pressure requirements needed for a hovercraft to lift a heavy payload. As a starting point, it is known that a leaf blower with about 3000 liters/min flow can lift a person. Based on these requirements, design and build new prototypes using more robust materials, with the ultimate goal of using them for a hovercraft.
2) As another application: The outward flow of air appears to stabilize the rotating device at higher RPM's so this effect may be used as a way to stabilize rotating machinery.
3) As another application: Bending the ends of the tubes so the exhaust is opposite the direction of rotation can decrease the energy required by a motor to spin the pump.
4) As another application: Use the effect to pump fuel such as $H_2O_2$ that can drive an engine or rocket propeller when ignited at a nozzle placed on the exhaust ends of bent tubes.

Supporting Data Table

Maximum flow values at each RPM. The maximum is used rather than the average because the maximum is assumed to have the least leakage between the flow sensor tube and the plastic disc inlet hole, and thus the least error.

| speed (rpm) | flow (l/min) | length of tube (m) | dia of tube (cm) |
|---|---|---|---|
| 162 | 0.071 | 0.117475 | 0.635 |
| 303.75 | 0.221 | 0.117475 | 0.635 |
| 478.75 | 0.436 | 0.117475 | 0.635 |
| 638.5 | 0.717 | 0.117475 | 0.635 |
| 664 | 0.734 | 0.117475 | 0.635 |
| 888 | 1.081 | 0.117475 | 0.635 |
| 1108 | 1.684 | 0.117475 | 0.635 |
| 1729.25 | 2.945 | 0.117475 | 0.635 |
| 2327 | 4.495 | 0.117475 | 0.635 |
| 2956.5 | 5.875 | 0.117475 | 0.635 |
| 260 | 0.06 | 0.0587375 | 0.635 |
| 390 | 0.133 | 0.0587375 | 0.635 |
| 545 | 0.257 | 0.0587375 | 0.635 |
| 637.5 | 0.334 | 0.0587375 | 0.635 |
| 680 | 0.356 | 0.0587375 | 0.635 |
| 905 | 0.565 | 0.0587375 | 0.635 |
| 1107.25 | 0.789 | 0.0587375 | 0.635 |
| 1733 | 1.494 | 0.0587375 | 0.635 |
| 2338.75 | 2.255 | 0.0587375 | 0.635 |
| 2997.25 | 2.998 | 0.0587375 | 0.635 |
| 294 | 0.029 | 0.02936875 | 0.635 |
| 515 | 0.103 | 0.02936875 | 0.635 |
| 625 | 0.145 | 0.02936875 | 0.635 |
| 636 | 0.152 | 0.02936875 | 0.635 |
| 801 | 0.233 | 0.02936875 | 0.635 |
| 906 | 0.288 | 0.02936875 | 0.635 |
| 1105 | 0.404 | 0.02936875 | 0.635 |
| 1731 | 0.776 | 0.02936875 | 0.635 |
| 2338 | 1.159 | 0.02936875 | 0.635 |
| 2995 | 1.586 | 0.02936875 | 0.635 |
| 636.75 | 0.046 | 0.117475 | 0.3175 |
| 1106.25 | 0.229 | 0.117475 | 0.3175 |
| 1729.25 | 0.605 | 0.117475 | 0.3175 |
| 2335.25 | 0.984 | 0.117475 | 0.3175 |
| 2985.5 | 1.539 | 0.117475 | 0.3175 |
| 636.75 | 0.017 | 0.0587375 | 0.3175 |
| 1108.25 | 0.088 | 0.0587375 | 0.3175 |
| 1733.25 | 0.252 | 0.0587375 | 0.3175 |
| 2341.75 | 0.488 | 0.0587375 | 0.3175 |
| 2999.75 | 0.702 | 0.0587375 | 0.3175 |
| 637 | 0.009 | 0.02936875 | 0.3175 |
| 1106 | 0.035 | 0.02936875 | 0.3175 |
| 1732 | 0.114 | 0.02936875 | 0.3175 |
| 2339 | 0.21 | 0.02936875 | 0.3175 |

-continued

| speed (rpm) | flow (l/min) | length of tube (m) | dia of tube (cm) |
|---|---|---|---|
| 2997 | 0.344 | 0.02936875 | 0.3175 |
| 6131 | 0.938 | 0.02936875 | 0.3175 |
| 7826 | 1.469 | 0.02936875 | 0.3175 |
| 7940 | 1.374 | 0.02936875 | 0.3175 |
| 9535 | 1.755 | 0.02936875 | 0.3175 |
| 9999 | 1.725 | 0.02936875 | 0.3175 |
| 186 | 0.201 | 0.117475 | 0.79375 |
| 312 | 0.428 | 0.117475 | 0.79375 |
| 450 | 0.643 | 0.117475 | 0.79375 |
| 575 | 0.866 | 0.117475 | 0.79375 |
| 637.75 | 1.056 | 0.117475 | 0.79375 |
| 1110 | 2.163 | 0.117475 | 0.79375 |
| 1732.25 | 3.727 | 0.117475 | 0.79375 |
| 2328.5 | 5.5 | 0.117475 | 0.79375 |
| 2994.75 | 7.147 | 0.117475 | 0.79375 |
| 200 | 0.098 | 0.0587375 | 0.79375 |
| 357 | 0.216 | 0.0587375 | 0.79375 |
| 575 | 0.425 | 0.0587375 | 0.79375 |
| 636.5 | 0.495 | 0.0587375 | 0.79375 |
| 1107.75 | 1.074 | 0.0587375 | 0.79375 |
| 1733.25 | 1.906 | 0.0587375 | 0.79375 |
| 2340 | 2.75 | 0.0587375 | 0.79375 |
| 2994.75 | 3.729 | 0.0587375 | 0.79375 |
| 375 | 0.105 | 0.02936875 | 0.79375 |
| 470 | 0.148 | 0.02936875 | 0.79375 |
| 560 | 0.212 | 0.02936875 | 0.79375 |
| 637 | 0.243 | 0.02936875 | 0.79375 |
| 690 | 0.291 | 0.02936875 | 0.79375 |
| 1107 | 0.582 | 0.02936875 | 0.79375 |
| 1733 | 1.05 | 0.02936875 | 0.79375 |
| 2340 | 1.564 | 0.02936875 | 0.79375 |
| 2997 | 2.153 | 0.02936875 | 0.79375 |
| 111 | 0.116 | 0.295275 | 0.635 |
| 224 | 0.439 | 0.295275 | 0.635 |
| 234.5 | 0.473 | 0.295275 | 0.635 |
| 412.5 | 1.221 | 0.295275 | 0.635 |
| 525 | 1.665 | 0.295275 | 0.635 |
| 525 | 1.704 | 0.295275 | 0.635 |
| 528.75 | 1.755 | 0.295275 | 0.635 |
| 565 | 1.858 | 0.295275 | 0.635 |
| 585 | 2.057 | 0.295275 | 0.635 |
| 610 | 2.072 | 0.295275 | 0.635 |
| 650 | 2.331 | 0.295275 | 0.635 |
| 818.75 | 3.039 | 0.295275 | 0.635 |
| 818.75 | 3.253 | 0.295275 | 0.635 |
| 636 | 0.525 | 0.08255 | cone |
| 1107.5 | 1.13 | 0.08255 | cone |
| 1732.5 | 1.988 | 0.08255 | cone |
| 2338.5 | 2.79 | 0.08255 | cone |
| 2990 | 3.777 | 0.08255 | cone |

The following patent and publications are incorporated by reference in their entireties: US Pub. No. 20130336806.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

We claim:

1. An improved centrifugal fluid flow pump assembly comprising:

an inflow rotating impeller device including a substantially circular base member supporting a plurality of individual fluid channel members which are in the form of tubes disposed along radii on a top surface of the base member, the fluid channel members having axes parallel with the radii of the base member, wherein an inlet of each of the fluid channel members is configured to be exposed to a gas flowing through the channel members, the fluid channel members arranged geometrically to maximize gas flow by maximizing tube density on the base member by covering the maximum area of the base member; and a rotating motor device coupled to the base member of the impeller device at a center point of the base member to facilitate axial movement of the base member, the rotating device configured for rotating the base member and the fluid channel members at a defined rate of revolutions per minute (RPM), wherein an increase of a flow rate of the gas exiting an outlet of each of the fluid channel members is faster than an increase in RPM therein exhibiting a superlinear flow, and wherein the increased exiting gas flow is a function of a non-expanding passageway along a structure of each of the plurality of the fluid channel members and exposure of the inlets of each of the fluid channel members to the gas flowing through the channel members.

2. The flow device of claim 1 wherein the gas is air.

3. The flow device of claim 1 wherein each of the fluid channel members is selected from the group consisting of a cylindrical tube, a square tube and a rectangular tube.

4. The flow device of claim 1 wherein the inlets of the fluid channel members are disposed at an inlet manifold located at an interior portion of the circular base member and the outlets of the fluid channel members are located at an outer edge of the circular base member.

5. A method of forming a superlinear outflow of a gas at an outlet of a fluid channel member of a fluid flow pump assembly comprising the steps of:

providing a plurality of individual fluid channel members which are in the form of tubes disposed along radii of a top surface of a planar circular base member, the fluid channel members having axes parallel with the radii of the base member, wherein an inlet of each of the fluid channel members is exposed to the gas flowing through the channel members, the fluid channel members configured to have non-expanding passageways along a structure of each of the channel members, the fluid channel members arranged geometrically to maximize gas flow by maximizing tube density on the base member by covering the maximum area of the base member; and rotating axially the planar circular base member at a center point of the base member, wherein the base member and the fluid channel members are rotated at a defined rate of revolutions per minute (RPM), and wherein an increase of a flow rate of the gas exiting the fluid channel members with non-expanding passageways is faster than an increase in RPM and produces higher pressures therein exhibiting superlinear flow.

* * * * *